US012344813B2

(12) United States Patent
Zaki et al.

(10) Patent No.: US 12,344,813 B2
(45) Date of Patent: Jul. 1, 2025

(54) WATER-BASED LUBRICATING GREASE COMPOSITIONS AND METHODS FOR USING THE SAME

(71) Applicant: Fuchs Petrolub SE, Mannheim (DE)

(72) Inventors: Nael Zaki, Kansas City, KS (US); H. Ray Enyard, Jr., Kansas City, KS (US)

(73) Assignee: Fuchs Petrolub SE, Mannheim (DE)

( * ) Notice: Subject to any disclaimer, the term of this patent is extended or adjusted under 35 U.S.C. 154(b) by 0 days.

(21) Appl. No.: 17/922,339

(22) PCT Filed: Jun. 10, 2021

(86) PCT No.: PCT/US2021/036851
§ 371 (c)(1),
(2) Date: Oct. 28, 2022

(87) PCT Pub. No.: WO2021/257382
PCT Pub. Date: Dec. 23, 2021

(65) Prior Publication Data

US 2023/0174888 A1 Jun. 8, 2023

Related U.S. Application Data

(60) Provisional application No. 63/039,018, filed on Jun. 15, 2020.

(51) Int. Cl.

| | |
|---|---|
| ***C10M 173/00*** | (2006.01) |
| ***C10M 173/02*** | (2006.01) |
| ***C10N 20/00*** | (2006.01) |
| ***C10N 30/00*** | (2006.01) |
| ***C10N 30/06*** | (2006.01) |
| ***C10N 30/12*** | (2006.01) |
| ***C10N 40/14*** | (2006.01) |
| ***C10N 50/10*** | (2006.01) |

(52) U.S. Cl.
CPC ..... *C10M 173/00* (2013.01); *C10M 173/02* (2013.01); *C10M 2201/02* (2013.01); *C10M 2201/062* (2013.01); *C10M 2201/082* (2013.01); *C10M 2201/1026* (2013.01); *C10M 2201/1036* (2013.01); *C10M 2201/1056* (2013.01); *C10M 2207/022* (2013.01); *C10M 2207/1265* (2013.01); *C10M 2207/1285* (2013.01); *C10M 2207/402* (2013.01); *C10M 2209/0866* (2013.01); *C10M 2209/103* (2013.01); *C10M 2209/126* (2013.01); *C10M 2219/022* (2013.01); *C10M 2219/046* (2013.01); *C10M 2221/04* (2013.01); *C10M 2223/047* (2013.01); *C10N 2020/081* (2020.05); *C10N 2030/06* (2013.01); *C10N 2030/12* (2013.01); *C10N 2030/62* (2020.05); *C10N 2040/14* (2013.01); *C10N 2050/10* (2013.01)

(58) Field of Classification Search
CPC ..... C10M 173/00; C10M 173/02; C10M 2201/02; C10M 2201/062; C10M 2201/082; C10M 2201/1026; C10M 2201/1036; C10M 2201/1056; C10M 2207/022; C10M 2207/1265; C10M 2207/1285; C10M 2207/402; C10M 2209/0866; C10M 2209/103; C10M 2209/126; C10M 2219/022; C10M 2219/046; C10M 2221/04; C10M 2223/047; C10N 2020/081; C10N 2030/06; C10N 2030/12; C10N 2030/62; C10N 2040/14; C10N 2050/10
See application file for complete search history.

(56) References Cited

U.S. PATENT DOCUMENTS

| | | | | |
|---|---|---|---|---|
| 8,507,421 | B2 | 8/2013 | Zaki | |
| 9,187,707 | B2 * | 11/2015 | Randisi, Sr. | C10M 177/00 |
| 2003/0220205 | A1 * | 11/2003 | Manka | C10M 177/00 508/180 |
| 2004/0053791 | A1 * | 3/2004 | Langer | C10M 177/00 508/180 |

FOREIGN PATENT DOCUMENTS

| | | | | |
|---|---|---|---|---|
| CN | 103242949 | A | 8/2013 | |
| EP | 3431574 | A1 * | 1/2019 | C10M 173/02 |
| IN | 202047007087 | * | 2/2020 | |
| JP | 2002146376 | A * | 5/2002 | |
| RU | 2712238 | | 1/2020 | |
| RU | 2753614 | | 8/2021 | |
| TW | 200617157 | A | 6/2005 | |
| TW | 201723162 | A | 3/2016 | |
| WO | WO-2019/016412 | A1 | 1/2019 | |

OTHER PUBLICATIONS

English language machine translation of JP 2002-146376 A (Year: 2002).*
International Search Report dated Aug. 31, 2021 for PCT/US2021/036851, 11 pages.
Office Action from Taiwan Application No. 110121618 Dated Nov. 16, 2021, 10 pages.
Office Action and Search Report from RU 2022133260 dated Oct. 29, 2024.

* cited by examiner

*Primary Examiner* — James C Goloboy
(74) *Attorney, Agent, or Firm* — Foley & Lardner LLP

(57) ABSTRACT

A water-based lubricating grease composition includes at least 40 wt % water; a salt-based thickener; a polymer-based thickener; and optionally, an inorganic solid-based thickener. A process for preparing the water-based lubricating grease composition may include blending a suitable amount of water with a salt-based thickener to provide a thickened water-based grease, wherein the salt-based thickener is obtained from contacting a base with a fat; and adding a polymer-based thickener to the thickened water-based grease.

13 Claims, No Drawings

WATER-BASED LUBRICATING GREASE COMPOSITIONS AND METHODS FOR USING THE SAME

CROSS-REFERENCE TO RELATED APPLICATIONS

This application is a National Phase entry of PCT/US2021/036851, filed Jun. 10, 2021, which claims the benefit of priority to U.S. Provisional Application No. 63/039,018, filed Jun. 15, 2020, the entirety of which is incorporated herein by reference.

FIELD

The present technology generally relates to lubricating greases, and in particular to water-based lubricating greases that include two or more thickeners, and a process for the production of such lubricating greases.

BACKGROUND

Water-based lubricating greases are an attractive alternative to hydrocarbon oil-based greases because water is one of the most abundant natural resources on our planet (71% of our earth surface is covered by water). Not only is water plentiful, but it is also nontoxic, and life cannot exist in its absence. Water is also recyclable through the water cycle, and it is the by-product of the combustion of organic fuels. Also, water cools much faster than oil which allows for the use of water-based lubricating greases to cool the surface metals and lubricate it at the same time. Furthermore, water-based lubricating greases may be used in various applications, including agricultural, forestry, marine, food grade processing, industrial, steel mill, and high temperature applications.

However, there are several disadvantages associated with water-based lubricating greases. One of the main disadvantages of using water in lubricating greases is the limited working temperature range for such greases (32 to 212° F./0 to 100° C.), as the grease cannot be used beyond the boiling point, or below the freezing point of the water. The second disadvantage for using water as the base for lubricating greases is the corrosive effect that water may have on lubricated metals. Additionally, water-based lubricating greases tend to be associated with microbial growth in the water-based components. Thus, there is a need for a water-based lubricating grease that addresses these disadvantages.

SUMMARY

In one aspect a water-based lubricating grease composition includes at least 40 wt % water; a salt-based thickener; and a polymer-based thickener.

In some embodiments, the composition further includes an inorganic solid-based thickener. In some embodiments, the composition may include from about 0.1 wt % to about 20 wt % of the inorganic solid-based thickener. In some embodiments, the composition may include from about 1 wt % to about 15 wt % of the inorganic solid-based thickener.

In some embodiments, the composition includes at least 60 wt % water. In some embodiments, the composition includes from about 40 wt % to about 90 wt % water or from 60 wt % to about 90 wt % water.

In some embodiments, the composition includes from about 0.1 wt % to about 30 wt % of the salt-based thickener.

In some embodiments, the composition includes from about 1 wt % to about 20 wt % of the salt-based thickener.

In some embodiments, the composition includes from about 0.1 wt % to about 15 wt % of the polymer-based thickener. In some embodiments, the composition includes from about 1 wt % to about 10 wt % of the polymer-based thickener.

In some embodiments, the composition includes from about 0.5 wt % to about 30 wt % of total thickener(s). In some embodiments, the composition includes from about 1 wt % to about 20 wt % of total thickener(s).

In some embodiments, the salt-based thickener includes a salt of sodium, potassium calcium, or magnesium. In some embodiments, the salt-based thickener includes a potassium, sodium, calcium, or magnesium salt of a $C_8$-$C_{32}$ fatty acid, a dicarboxylic acid, a hydroxy fatty acid, or a hydrogenated castor oil. In some embodiments, the hydroxy fatty acid is 12-hydroxystearic acid.

In some embodiments, the polymer-based thickener includes a naturally occurring polymer or a synthetic polymer. In some embodiments, the polymer-based thickener includes carboxy methyl cellulose or carboxy ethyl cellulose, or a salt or a derivative thereof. In some embodiments, the polymer-based thickener includes gelatin, agar, bitulin, a polysaccharide, a water soluble protein, lignin, lignin sulfonate, or derivative thereof. In some embodiments, the polymer-based thickener includes a polyglycol, a polyalkylene glycol, a polyamide, or a derivative thereof.

In some embodiments, the solid inorganic-based thickener includes fumed silica, silanized fumed silica, hydrophobized fumed silica, bentonite, clay, or derivative thereof.

In some embodiments, the composition further includes one or more additives that may include water soluble corrosion inhibitors, anti-wear and load carrying capacity enhancing additives, water miscible boiling point elevators, freezing point depressants, and a mixture of any two or more thereof. In some embodiments, the composition further includes a water soluble corrosion inhibitor. In some embodiments, the water soluble corrosion inhibitor includes a metal salt of sulfonic acid, a metal salt of $C_8$-$C_{32}$ fatty acid, a nitrite salt, an alkanol amines, an amine salt, an imidazoline, an acid amide, or a combination thereof.

In some embodiments, the composition further includes an anti-wear and load carrying capacity enhancing additive that may include molybdenum dithiocarbamate, molybdenum dithiophosphate, molybdenum disulfide, zinc dialkyldithiophosphate, or over-based calcium sulfonate. In some embodiments, the composition may also include a water miscible boiling point elevator and freezing point depressant including glycol, polyglycol, glycerol, propylene glycol, an alkaline earth metal salt, and citric acid, a salt or a combination thereof.

In some embodiments, the composition is a high temperature fire resistant grease. In some embodiments, the composition does not catch fire when subjected to direct flame and or sparks. In some embodiments, the high temperature is a temperature that exceeds the flash point of hydrocarbon mineral oil or hydrocarbon synthetic oils based greases and/or is above 500° F.

In some embodiments, the composition is a lubricant for electric vehicles, whereby electric conductivity is highly desired. In some embodiments, the composition has a conductivity that prevents the electric discharge currents that occur in hydrocarbon-based greases and can damage the bearings due to sparking.

In some embodiments, the composition is food safe and/or used in food processing machinery. In some embodiments, the composition complies with NSF H1 regulation for food safe lubricants and NSF Standard 61 for Drinking Water System lubricant.

In some embodiments, the composition is environmentally friendly and biodegradable. In some embodiments, the non-water components in the composition are biodegradable by more than 65% in 28 days according to the OECD 301B biodegradability test method standard.

In some embodiments, the composition is a lubricant for agricultural machinery equipment, forestry equipment, railroad curve and flange side rail, and/or marine applications where aquatic life is in jeopardy when using hydrocarbon-based greases.

In one aspect is a process for preparing any one of the water-based lubricating grease composition described herein, the process including:

blending a suitable amount of water with a salt-based thickener to provide a thickened water-based grease, wherein the salt-based thickener is obtained from contacting a base with a fat; and adding a polymer-based thickener to the thickened water-based grease.

In some embodiments, the process further includes adding an inorganic solid-based thickener. In some embodiments, the process further includes adding one or more additives.

DETAILED DESCRIPTION

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s).

Water-Based Lubricating Grease Compositions

Described herein are water-based lubricating greases that are suitable for use in a variety of applications, including agricultural machinery, forestry, marine and waterway machinery, food grade processing machinery lubricant, industrial machinery, steel mills and high temperature applications. The water-based grease compositions described herein include thickening agents, such as a salt-based thickener, a polymer-based thickener, and an inorganic solid-based thickener. In some embodiments, the thickening agents work synergistically to thicken the grease. In some embodiments, the thickening agents minimize water evaporation during use.

The water-based lubricating greases described herein are renewable and sustainable lubricating greases. Water is not a greenhouse material, and it does not cause ozone depletion. Water is a renewable material that our planet is filled with. As the water-based lubricating greases herein contain water as the major component, these greases are considered as sustainable lubricants. Sustainable lubrication is defined here with regard to lubricants composed of compounds that are based on renewable resources. The water-based lubricating grease compositions herein may utilize other natural and renewable materials, such as the thickeners and additives described herein.

The water-based lubricating greases described herein have one or more of the following technical advantages over hydrocarbon oil-based greases. The water-based lubricating grease described herein may be used at relatively high temperatures for intermittent periods of time with low water evaporation due to the addition of the thickeners or additives that act to increase the boiling point of water, and most importantly capture water through hydrogen bonding to reduce the water evaporation at high temperatures. The same thickeners or additives that elevate the boiling point of water also depress the freezing point of water, allowing the water-based grease to operate at much lower temperatures below the freezing point of water. Thus, the thickeners and additives work together to expand the workable range of the water-based greases of which they are a part of.

Water-soluble corrosion inhibitors may also be added to the greases to protect the lubricated metal surface from corrosion. Also, the water-based lubricating greases described herein are manufactured from non-toxic environmentally friendly materials, thus allowing for registration as being food grade NSF and NSF 61 compliant lubricant and for potential use in environmentally sensitive areas. Additionally, the water-based lubricating greases described herein may also be used in areas where fire resistant lubricating greases are desired, such as in high temperature steel mills. Using water-based lubricating greases also allows for the use of water-soluble chemicals that have desirable properties that could not have been otherwise used in hydrocarbon oil-based traditional greases.

Provided herein is a water-based lubricating grease composition including at least 40 wt % water; a salt-based thickener; and a polymer-based thickener. The water-based lubricating grease composition may also include an inorganic solid-based thickener.

As used herein, a water-based lubricating grease refers to a grease where water represents the base fluid for the grease. Water miscible and water immiscible components, such as the thickeners and/or additives described herein, are added to impart various desirable properties to the water-based grease. In some embodiments, the composition includes at least about 40 wt % water, including at least about 45 wt %, at least about 50 wt %, at least about 55 wt %, at least about 60 wt %, at least about 65 wt %, at least about 70 wt %, at least about 75 wt %, at least about 80 wt %, at least about 85 wt %, and at least about 90 wt %. In some embodiments, the composition includes from about 40 wt % to about 90 wt % water or from 60 wt % to about 90 wt % water, including about 40 wt %, about 45 wt %, about 50% wt, about 55% wt, about 60 wt %, about 65 wt %, about 70 wt %, about 75 wt %, about 80 wt %, about 85 wt %, and about 90 wt %. In some embodiments, the composition includes from about 40 wt % to about 90 wt % water, including from about 60 wt % to about 90 wt % water.

The water-based lubricating grease compositions described herein may further include an inorganic solid-based thickener. Illustrative inorganic solid-based thickeners include, but are not limited to, fumed silica, silanized fumed silica, hydrophobized fumed silica, bentonite, clay, and derivatives thereof. Other illustrative inorganic solid-based thickeners include, but are not limited to, silicic acid, silica gel, mica, talc, graphite, boron nitride, zinc oxide, polytetrafluoroethylene (PTFE), and cyanuric acid and its salts (e.g., zinc cyanurate).

In some embodiments, the composition includes from about 0.1 wt % to about 20 wt % of the inorganic solid-based thickener, including about 0.1, about 0.2, about 0.3, about 0.4, about 0.5, about 0.6, about 0.7, about 0.8, about 0.9, about 1, about 2, about 3, about 4, about 5, about 6, about 7, about 8, about 9, about 10, about 15, or about 20 wt %. In some embodiments, wherein the composition includes from about 0.5 wt % to about 10 wt % or from about 1 wt % to about 15 wt % of the inorganic solid-based thickener.

The water-based lubricating grease compositions described herein may include a salt-based thickener. Illustrative salt-based thickeners include, but are not limited to, salts of sodium, potassium, calcium, and magnesium. Salt-based thickeners contemplated for use include fatty acid metallic and organic salts of amines, alkanolamines and derivatives thereof. Other examples of salt-based thickeners include potassium, sodium, calcium, and magnesium salts of a $C_8$-$C_{32}$ fatty acid, a dicarboxylic acid, a hydroxy fatty acid, or a hydrogenated castor oil. In some embodiments, the hydroxy fatty acid is 12-hydroxystearic acid.

In some embodiments, the composition includes from about 0.1 wt % to about 30 wt % of the salt-based thickener, including about 0.1, about 0.2, about 0.3, about 0.4, about 0.5, about 0.6, about 0.7, about 0.8, about 0.9, about 1, about 2, about 3, about 4, about 5, about 6, about 7, about 8, about 9, about 10, about 15, about 20, about 25, or about 30 wt %. In some embodiments, the composition includes from about 1 wt % to about 15 wt % or from about 1 wt % to about 20 wt % of the salt-based thickener.

The water-based lubricating grease compositions described herein may include a polymer-based thickener. The polymer-based thickeners may be naturally occurring polymers or synthetic polymers. Illustrative polymer-based thickeners include, but are not limited to, carboxy methyl cellulose, carboxy ethyl cellulose, and salts or derivatives thereof. Other examples of polymer-based thickeners include, but are not limited to, gelatin, agar, bitulin (obtained from Birch tree barks), a polysaccharide, a water soluble protein, lignin, lignin sulfonate, and derivatives thereof. In some embodiments, the polymer-based thickener includes a polyglycol, a polyalkelene glycol, a polyamide, polyacrylic acid, polyvinyl acetate, a polyacrylate, a maleic/acrylic copolymer, styrene/maleic anhydride resin, an acrylate copolymer, or a fluoroacrylate, or a derivative thereof. The polymer-based thickener may also include mixtures of any two or more such thickeners illustrated herein.

In some embodiments, the composition includes from about 0.1 wt % to about 30 wt % of the polymer-based thickener, including about 0.1, about 0.2, about 0.3, about 0.4, about 0.5, about 0.6, about 0.7, about 0.8, about 0.9, about 1, about 2, about 3, about 4, about 5, about 6, about 7, about 8, about 9, about 10, about 15, about 20, about 25, or about 30 wt %. In some embodiments, the composition includes from about 0.1 wt % to about 15 wt %, from about 1% wt to about 10 wt %, from about 1 wt % to about 15 wt % of the polymer-based thickener.

The water-based lubricating grease compositions described herein include from about 0.5 wt % to about 30 wt % of total thickener(s), based upon the total weight of the water-based lubricating grease composition, including about 0.1, about 0.2, about 0.3, about 0.4, about 0.5, about 0.6, about 0.7, about 0.8, about 0.9, about 1, about 2, about 3, about 4, about 5, about 6, about 7, about 8, about 9, about 10, about 15, about 20, about 25, or about 30 wt % of total thickener(s). In some embodiments, the total thickeners may include a salt-based thickener and a polymer-based thickener. In some embodiments, the total thickeners may include a salt-based thickener, a polymer-based thickener, and an inorganic solid-based thickener. In some embodiments, the composition includes from about 0.5 wt % to about 20 wt %, from about 1 wt % to about 20 wt % or from about 1 wt % to about 15 wt % of total thickener(s).

The water-based lubricating grease compositions described herein are prepared to pass the FE8 Test. The FE8 test is a FAG Wear Bearing Grease Test, an industrial standard test that is used to evaluate the tested bearing grease's ability to minimize friction and wear. The FE8 Test includes loading a pair of bearings with the test grease, applying a certain load (typically measured in Newtons) and continuously running the bearings under specified speed and temperature for a specified period of time (i.e. 500 hours/21 days). During the test, the torque and temperature are continuously measured. If the torque or the temperature of the bearings exceeds a specified value maximum, the machine automatically shuts down. The test is considered a pass if 500 hours are obtained without the torque or temperature exceeding the specified value maxima. Also, the weight loss of the bearing elements (rollers, inner race, outer race and cage) are then recorded to examine how successful the grease was at minimizing wear. In some embodiments, the bearings type are tapered roller bearings. In some embodiments, the FE8 test conditions are a 50 kN (kiloNewtons) load and 75 RPM rotation speed, with fan cooling during the test.

Additives may be also added to the water-based lubricating grease compositions to impart a variety of desirable properties. Additives contemplated for use herein include one or more of those such as water soluble corrosion inhibitors, anti-wear and load carrying capacity enhancing additives, water miscible boiling point elevators, freezing point depressants, and a mixture of any two or more thereof. Microencapsulated aqueous soluble additives may also be incorporated into the water-based lubricating grease compositions described herein. Detergents may also be incorporated to remove the wear and imperfections that may form during the friction of the lubricated metal surface. Such detergents may improve wear characteristics, and increase the lifetime and cleanliness of the lubricated metal part.

In some embodiments, the water-based lubricating grease composition includes a water soluble corrosion inhibitor. Illustrative water soluble corrosion inhibitors include, but are not limited to, an alkyl or alkyl aryl sulfonic acids, a metal salt of an alkyl or alkyl aryl sulfonic acid (e.g., sodium, calcium and magnesium), a metal salt of a $C_8$-$C_{32}$ fatty acid, a nitrite salt, a alkanol amine, a amine salt, an imidazoline, an acid amide, or a combination of any two or more thereof.

In some embodiments, the water-based lubricating grease composition further includes an anti-wear and load carrying capacity enhancing additive. Illustrative anti-wear and load carrying capacity enhancing additives include, but are not limited to, molybdenum dithiocarbamate, molybdenum dithiophosphate, molybdenum disulfide, zinc dialkyldithiophosphate, over-based calcium sulfonate, triphenyl thiophosphate, a phosphate ester, a fatty acid ester, a polyol ester, a trimethylolpropane ester, a pentaerythritol ester, a polyalkylene glycol, a polyalkylene glycol ester, or a mixture of any two or more thereof.

In some embodiments, the water-based lubricating grease composition further includes a water miscible boiling point elevator and freezing point depressant. Illustrative water-miscible boiling point elevators and freezing point depressants include, but are not limited to, glycol, polyglycol, glycerol, propylene glycol, an alkaline earth metal salt, a polyglycol with a molecular weight that is sufficient to thicken the compositions described herein ranging from about 1000 g/mol to about 500,000 g/mol, and citric acid, or a salt or a combination thereof.

Process of Making

Also provided in one aspect, is a process for preparing the water-based lubricating grease compositions. The process includes blending a suitable amount of water with a salt-based thickener to provide a thickened water-based grease, wherein the salt-based thickener is obtained from contacting a base with a fat; and adding a polymer-based thickener to the thickened water-based grease.

In some embodiments, the process further includes adding an inorganic solid-based thickener. In some embodiments, the process further includes adding one or more additives, such as the additives described herein.

In one embodiment, the water-based grease composition is prepared in an open kettle or pressure grease cooking kettle, such as a Stratco contactor or autoclave. For the open kettle cooking procedure, a suitable amount of water, such as about 40% of water, and a base, such as potassium hydroxide or sodium hydroxide, are pumped in the grease cooking vessel, then the fats, such as 12-hydroxy stearic acid, hydrogenated castor oil, stearic acid, and dicarboxylic acids, are added to the kettle. Upon addition, the temperature rises spontaneously due to the exothermic nature of the saponification reaction. The temperature is then maintained within a suitable range (i.e., from about 100 to 150° F.), until all of the fats are reacted with the base to provide a thickened water-based grease.

The next step of the preparation is to add a first, suitable amount of water to the thickened water-based grease or formed soap. This amount may be from about 10 wt % to about 80 wt % of the total water needed for the grease composition. The polymer-based thickener is then added. Examples of polymer-based thickeners include, but are not limited to, carboxy methyl cellulose, carboxy ethyl cellulose and derivatives thereof and their sodium and potassium salts were added to impart a secondary thickening effect. Other natural polymers, such as gelatin, agar, bitulin, polysaccharides, water soluble proteins, lignin, lignin sulfonate, and derivatives thereof, may also be added. The water-based grease is then pumped to a finishing kettle, where it is cooled gradually. When the temperature reaches at an appropriate temperature, such as about 100° F., the inorganic solid-based thickener, if used, may be added. Illustrative inorganic solid-based thickeners include fumed silica, silanized fumed silica, hydrophobized fumed silica, bentonite, clay, and derivatives thereof. Examples of the inorganic solid-based thickener include untreated fumed silica, organic modified silica, and organic treated bentonite, also called rheological additive. After the solid-based inorganic thickener, performance additives and other functional additives may be added. Illustrative functional additives include phosphate ester, trimethylopropane ester, pentaerythritol ester, amine derived antioxidant, phenol derived antioxidant, a sulfonate derivative corrosion inhibitor, and triphenyl phosphate ester. The grease is milled (homogenized) and mixed thoroughly with the additives. A second, further water addition is then conducted to obtain the desired consistency (i.e. NLGI grade or degree of softness) of the water-based grease. A similar procedure may be carried out in one kettle from start to finish without the need to transfer the grease from a cooking kettle to a finishing kettle.

Applications

The water-based lubricating grease compositions may be used in a variety of commercial applications. The water-based lubricating greases described herein may be employed in applications that require extreme temperature resistance. For example, they may be used in steel mills, especially if the water-based lubricating greases are high dropping point greases. The water-based lubricating greases described herein may also be used in applications that required fire resistance. As the components of the water-based lubricating grease compositions are non-toxic and environmentally benign, the water-based lubricating greases described herein may also be used in food applications and applications where environmental safety is a concern, including forestry and agricultural machinery lubrication, railroad lubrication, off highway machinery lubrication, marine and harbor cranes lubrication, tug boats and boat lifters lubrication, and the like. For example, the water-based lubricating greases may be registered as food grade grease from NSF (National Sanitation Foundation) and/or registered as Kosher and Halal. It is also possible to use the water-based lubricating grease compositions for lubricating bearings in food processing plants. In some embodiments, the water-based lubricating grease compositions maybe used in bearings that demand high electric conductivity (e.g., e-mobility and electric cars).

The water-based lubricating grease compositions may have high flame-retardant effect so that the grease does not catch fire even when subjected to open flame and sparks encountered with high temperature metal processing plants (steel mills). In some embodiments, the composition is a high temperature fire resistant grease. In some embodiments, the composition is fire resistant when subjected to direct flame and or sparks. Fire resistant can include self-extinguishing compositions or complete fire resistance. In some embodiments, the high temperature is a temperature that exceeds the flash point of hydrocarbon mineral oil or hydrocarbon synthetic oil-based greases and/or is above 500° F.

In some embodiments, the water-based lubricating grease composition may be a lubricant for electric vehicles, whereby electric conductivity is highly desired. In some embodiments, the composition has a conductivity that prevents the electric discharge currents that occur in hydrocarbon-based greases and can damage the bearings due to sparking.

In some embodiments, the water-based lubricating grease composition is environmentally friendly and biodegradable. In some embodiments, non-water components in the composition are biodegradable by more than 65% in 28 days according to the OECD 301B biodegradability test method standard. In some embodiments, the composition is a lubricant for agricultural machinery equipment, forestry equipment, railroad curve and flange side rail, and/or marine applications where aquatic life is in jeopardy when using hydrocarbon-based greases.

The present invention, thus generally described, will be understood more readily by reference to the following examples, which are provided by way of illustration and are not intended to be limiting of the present invention.

EXAMPLES

Example 1

Water-Based Lubricating Grease Having Two Thickeners

The grease was made in an open kettle. In the open kettle cooking procedure at room temperature, about 40 wt % $H_2O$ and about 1 to 5 wt % KOH or NaOH were pumped in the grease cooking vessel, followed by addition of the fats to the kettle. For this example, the fats used were oleic acid and stearic acid. The temperature rose spontaneously due to the exothermic nature of the saponification reaction, forming the soap (saponified fats). The temperature was then maintained from 100-150° F. until all the fats were reacted with the KOH or NaOH, causing a substantial thickening of the grease to occur.

Then, about 20 wt % of the total water was added to the formed soap, followed by the polymer-based thickener. In this example, carboxy methyl cellulose, was added to impart a secondary thickening effect.

The grease was then pumped to a finishing kettle where it was gradually cooled. When the temperature reached about 100° F., the solid additives and other functional additives according to Table 1 were added. The grease was milled and mixed thoroughly with the additives and further water was added to obtain the desired consistency (NLGI grade or degree of softness) of the grease.

Table 1 shows the specific components and amounts of the grease formulation that was prepared in this example. Table 2, below, illustrates the performance characteristics for a water-based grease with two thickeners: a salt-based thickener and a polymer-based thickener.

TABLE 1

Grease Formulation of Example 1.

| Raw Material | wt % |
|---|---|
| Water | 60 |
| Oleic Acid | 10 |
| Stearic Acid | 8 |
| Potassium Hydroxide 45% solution | 6.9 |
| Calcium Hydroxide (Hydrated Lime) | 2 |
| Calcium Carbonate | 2 |
| Carboxy methyl cellulose | 2 |
| Talc | 3 |
| Polyalkylene Glycol | 5 |
| Phosphate Ester | 0.1 |
| 400 TBN Calcium alkyl sulfonate | 1 |
| Glycerol | 5 |
| Sodium Nitrite | 0.5 |

TABLE 2

Testing of the Grease Formulation of Example 1.

| Test | Method | Grease Formulation of Example 1 |
|---|---|---|
| Cone Penetration 0X | ASTM D-217 | 281 |
| Cone Penetration 60X | ASTM D-217 | 282 |
| 4-Ball Wear Scar Diameter | ASTM D-2266 | 0.52 mm |
| 4-Ball Weld Point | ASTM D-2596 | 200 Kgf |
| Rust Bearing Test with synthetic sea water | ASTM D-1743 | Pass |
| Cu Corrosion | ASTM D-130 | 1B |
| Dropping Point | ASTM D-2265 | 189° C. |
| Open Flame flammability Test | Derivative of Flash Point Open Cup Test | Does not catch fire |
| USS Mobility @ −20 C. | US Steel Method[1] | 7.6 grams/minute |
| FAG FE-8[2] | 50 kN, 75 rpm, 500 hrs | Passed 500 Hours Test (0.082 g wear) |

[1]= The grease sample was cooled to the required temperature then pressurized with nitrogen at 150 psi. Then the amount of grease pumped at this temperature and pressure per minute were calculated.

[2]= A pair of tapered roller bearings were packed with the tested grease and was run under a specified load and speed for 500 hours. The torque and temperature were constantly monitored during the run. The machine automatically was set to shut down if the temperature or torque exceeded a specific value based on the set of speeds and loads. The weight loss of all the bearing components was measured before and after the test conclusion and reported.

As seen from the above table, the water-based grease with two thickeners performed similarly as oil-based greases with a dropping point similar to the simple lithium greases, which typically ranges between 160-200° C. from lubricating grease literature well known to those skilled in the art (e.g., *Lubricants and Lubrication*, Volume 2, Chapter 16 Lubricating Grease, Edited by T. Mang and W. Dresel, 3rd Edition, Publisher Wiley-VCH 2017). The water-based grease pumped at temperatures as low as −20° C. (−4° F.) and at temperatures as high as 189° C. (372° F.). The grease also passed 21 days (500 hours) wear bearing test FE8 at relatively high load 50 kN and moderate speed 75 RPM with very low wear and without exceeding the maximum allowed torque for this test condition.

The water-based grease of this Example also passed the corrosion bearing test using a synthetic sea water environment. The sea water test environment subjected the grease to very harsh conditions for any grease to withstand, much less a water based grease. However, the water-based grease with two thickeners passed this test in synthetic sea water for 48 hours. The synthetic sea water chemical composition used was as follows:

TABLE 3

Synthetic Sea Water Chemical Composition.

| Salt | Wt %* |
|---|---|
| NaCl | 2.454% |
| $MgCl_2 \cdot 6H_2O$ | 1.110% |
| $Na_2SO_4$ | 0.409% |
| $CaCl_2$ | 0.116% |
| KCl | 0.069% |
| $NaHCO_3$ | 0.020% |
| KBr | 0.010% |
| $H_3BO_3$ | 0.003% |
| $SrCl_2 \cdot 6H_2O$ | 0.004% |
| NaF | 0.0003% |

*= Water accounted for the remaining balance.

The total salt concentration for the above synthetic sea water composition was 4.1953%

The water-based grease with the two thickeners exhibited medium range extreme temperature capacity of about 200 Kgf ("kilogram-force") weld load result per the standard test method for testing the load carrying capacity of lubricating grease with a 4 Ball weld load test ASTM D 2596. The water-based grease exhibited very good anti wear characteristics attested to by a small wear scar diameter of the 4-ball wear standard test method ASTM D 2266. Finally, the water-based grease did not cause copper corrosion when tested according to the ASTM D 130. This result indicates that the water-based grease described herein can be used safely in lubricating bearings and other mobile parts that contain copper or are formed of copper alloys, such as brass, bronze, and etc.

Example 2

Water-Based Lubricating Grease with Three Thickeners

The grease was made in an open kettle. In the open kettle cooking procedure, about 40 wt % of water, about 1 to 5 wt % KOH or NaOH were pumped in the grease cooking vessel along with the fats. For this example, the fats used were oleic acid, steric acid, and 12-hydroxy stearic acid. As this saponification reaction progressed, the temperature rose spontaneously. The temperature was then maintained from about 100 to 150° F. until all of the fats were reacted with the KOH or NaOH, causing a substantial thickening of the grease to occur.

The second step was to add 20% water to the formed soap along with the polymer thickener. Sodium carboxy methyl cellulose and polyacrylic acid were used in this example as shown in the below table. A natural polymer, such as lignin sulfonate, was also used.

The grease was then pumped to a finishing kettle where it was gradually cooled. When the temperature reached about 100° F., a third inorganic solid-based thickener was added. In this example, the third inorganic solid-based thickeners were untreated fumed silica, organic modified silica, and organic treated bentonite, also called rheological additive. After the addition of the third solid-based inorganic thickener, performance additives and other functional additives were added. For this example, the functional additives were phosphate ester, trimethylopropane ester, pentaerythritol ester, amine derived antioxidant, phenol derived antioxidant, a sulfonate derivative corrosion inhibitor, and triphenyl phosphate ester. The grease was milled (homogenized) and mixed thoroughly with the additives and further water was added to obtain the desired consistency (NLGI grade or degree of softness) of the grease.

Table 4 shows the specific components and amounts of the grease formulation that was prepared in this example. Table 5 lists the performance data for a water-based grease with three thickeners: a salt-based thickener, a polymer-based thickener, and inorganic solid-based thickener.

TABLE 4

Grease Formulation of Example 2.

| Raw Material | wt % |
|---|---|
| Water | 63 |
| Oleic Acid | 2 |
| Stearic Acid | 2 |
| 12 Hydroxy Stearic Acid | 2 |
| Hydrogenated Castor Oil | 2 |
| Potassium Hydroxide 45% solution | 3 |
| Calcium Hydroxide (Hydrated Lime) | 2 |
| Calcium Carbonate | 2 |
| Carboxy methyl cellulose | 2 |
| Trimethylolpropane Trioleate Ester | 2 |
| Polyacrylic Acid | 2 |
| Talc | 3 |
| Untreated Silica | 1 |
| Hydrophobized Treated Silica | 1 |
| Treated Bentonite | 1 |
| Triphenyl Thiophosphate | 1 |
| Sulfurized Olefin | 1 |
| Calcium Lignin sulfonate | 2 |
| Polyalkylene Glycol | 4.7 |
| Phosphate Ester | 0.1 |
| Amininc Antioxidant | 0.1 |
| Phenolic Antioxidant | 0.1 |
| 400 TBN Calcium alkyl sulfonate | 1 |
| Glycerol | 5 |
| Sodium Nitrite | 0.5 |

TABLE 5

Testing of the Grease Formulation of Example 2.

| Test | Method | Grease Formulation of Example 2 |
|---|---|---|
| Cone Penetration 0X | ASTM D-217 | 285 |
| Cone Penetration 60X | ASTM D-217 | 289 |
| 4-Ball Wear Scar Diameter | ASTM D-2266 | 0.55 mm |
| 4-Ball Weld Point | ASTM D-2596 | 250 kgf |
| 4-Ball Load Wear Index | ASTM D-2596 | 65 |
| Rust Bearing Test with synthetic sea water | ASTM D-1743 | Pass |
| Copper Corrosion | ASTM D-130 | 1B |
| Open Flame flammability Test | Derivative of Flash Point Open Cup Test | Does not catch fire |

TABLE 5-continued

Testing of the Grease Formulation of Example 2.

| Test | Method | Grease Formulation of Example 2 |
|---|---|---|
| USS Mobility @ −20 C. | US Steel Low Temperature Pumpability Test[1] | 9.2 grams/minute |
| Dropping Point | ASTM D-2265 | >280° C. |
| FAG FE-8 Wear Expressed as Mass Loss[2] | 50 kN, 75 rpm, 500 hrs | Passed 500 Hours Test (0.013 g wear) |
| FAG FE-8 Maximum Measured Torque (Nm)[3] | 50 kN, 75 rpm, 500 hrs | <60N |

[1]= The grease sample was cooled to the required temperature then pressurized with nitrogen at 150 psi then the amount of grease pumped at this temperature and pressure per minute was calculated.

[2]= A pair of tapered roller bearings were packed with the tested grease and was run under a specified load and speed for 500 hours. The torque and temperature were constantly monitored during the run. The machine automatically was set up to shut down if the temperature or torque exceeded a specific value based on the set of speeds and loads. The weight loss of all the bearing components was measured before and after the test conclusion and reported.

[3]= A pair of tapered roller bearings were packed with the tested grease and was run under a specified load and speed for 500 hours. The torque and temperature were constantly monitored during the run. The machine automatically was set up to shut down if the temperature or torque exceeded a specific value based on the set of speeds and loads. The weight loss of all the bearing components was measured before and after the test conclusion and reported.

As observed from Table 5, the water-based-grease with three thickeners performed similarly as normal oil-based greases with a dropping point similar a lithium complex grease, which typically ranges between 220-280° C. from lubricating grease literature well known to those skilled in the art (e.g., *Lubricants and Lubrication*, Volume 2, Chapter 16 Lubricating Grease, Edited by T. Mang and W. Dresel, 3rd Edition, Publisher Wiley-VCH, 2017). The water-based grease pumped at low temperatures as low as −20° C. (−4° F.) and worked to a top temperature of about 260° C. (about 500° F.). The water-based grease passed 21 days (500 hours) wear bearing test FE8 at relatively high load 50 kN and moderate speed 75 RPM with very low wear and without exceeding the maximum allowed torque for this test condition (<60 N).

The water-based grease also passed the corrosion bearing test using synthetic sea water environment which is a very harsh conditions for any grease to withstand. However, the water-based grease with triple thickener passed this test in synthetic sea water for 48 hours. The synthetic sea water chemical composition used is outlined in Table 3.

The water-based grease exhibited medium range extreme load carrying capacity of 250 Kgf weld load result per the standard test method for testing the load carrying capacity of lubricating grease with a 4 Ball weld load test ASTM D 2596. The water-based grease exhibited very good anti wear characteristics attested to by a small wear scar diameter of the 4-ball wear standard test method ASTM D 2266. Finally, the water-based grease did not cause copper corrosion when tested according to the ASTM D 130. This result means that the water-based grease described herein can be used safely in lubricating bearings and other mobile parts that contain copper or are formed of copper alloys, such as brass, bronze, etc.

Para. 1. A water-based lubricating grease composition comprising:

at least 40 wt % water;

a salt-based thickener; and a polymer-based thickener.

Para. 2. The composition of Para. 1, wherein the composition further comprises an inorganic solid-based thickener.

Para. 3. The composition of Para. 2, wherein the composition comprises from about 0.1 wt % to about 20 wt % of the inorganic solid-based thickener.

Para. 4. The composition of Para. 3, wherein the composition comprises from about 1 wt % to about 15 wt % of the inorganic solid-based thickener.

Para. 5. The composition of any one of Paras. 1-4, wherein the composition comprises at least 60 wt % water.

Para. 6. The composition of Para. 5, wherein the composition comprises from about 40 wt % to about 90 wt % water or from 60 wt % to about 90 wt % water.

Para. 7. The composition of any one of Paras. 1-6, wherein the composition comprises from about 0.1 wt % to about 30 wt % of the salt-based thickener.

Para. 8. The composition of Para. 7, wherein the composition comprises from about 1 wt % to about 20 wt % of the salt-based thickener.

Para. 9. The composition of any one of Paras. 1-8, wherein the composition comprises from about 0.1 wt % to about 15 wt % of the polymer-based thickener.

Para. 10. The composition of Para. 9, wherein the composition comprises from about 1 wt % to about 10 wt % of the polymer-based thickener.

Para. 11. The composition of any one of Paras. 1-10, wherein the composition comprises from about 0.5 wt % to about 30 wt % of total thickener(s).

Para. 12. The composition of Para. 11, wherein the composition comprises from about 1 wt % to about 20 wt % of total thickener(s).

Para. 13. The composition of any one of Paras. 1-12, wherein the salt-based thickener comprises a salt of sodium, potassium calcium, or magnesium.

Para. 14. The composition of any of Paras. 1-13, wherein the salt-based thickener comprises a potassium, sodium, calcium, or magnesium salt of a $C_8$-$C_{32}$ fatty acid, a dicarboxylic acid, a hydroxy fatty acid, or a hydrogenated castor oil.

Para. 15. The composition of Para. 14, wherein the hydroxy fatty acid is 12-hydroxystearic acid.

Para. 16. The composition of any one of Paras. 1-15, wherein the polymer-based thickener comprises a naturally occurring polymer or a synthetic polymer.

Para. 17. The composition of Para. 16, wherein the polymer-based thickener comprises carboxy methyl cellulose or carboxy ethyl cellulose, or a salt or a derivative thereof.

Para. 18. The composition of Para. 16, wherein the polymer-based thickener comprises gelatin, agar, bitulin, a polysaccharide, a water soluble protein, lignin, lignin sulfonate, or derivative thereof.

Para. 19. The composition of Para. 16, wherein the polymer-based thickener comprises a polyglycol, a polyalkylene glycol, a polyamide, or a derivative thereof.

Para. 20. The composition of any one of Paras. 2-19, wherein the solid inorganic-based thickener comprises fumed silica, silanized fumed silica, hydrophobized fumed silica, bentonite, clay, or derivative thereof.

Para. 21. The composition of any one of Paras. 1-20, wherein the composition further comprises one or more additives selected from the group consisting of water soluble corrosion inhibitors, anti-wear and load carrying capacity enhancing additives, water miscible boiling point elevators, freezing point depressants, and a mixture of any two or more thereof.

Para. 22. The composition of any one of Paras. 1-20, wherein the composition further comprises a water soluble corrosion inhibitor.

Para. 23. The composition of Para. 22, wherein the water soluble corrosion inhibitor comprises a metal salt of sulfonic acid, a metal salt of $C_8$-$C_{32}$ fatty acid, a nitrite salt, an alkanol amines, an amine salt, an imidazoline, an acid amide, or a combination thereof.

Para. 24. The composition of any one of Paras. 1-20, wherein the composition further comprises a anti-wear and load carrying capacity enhancing additive comprising molybdenum dithiocarbamate, molybdenum dithiophosphate, molybdenum disulfide, zinc dialkyldithiophosphate, or overbased calcium sulfonate.

Para. 25. The composition of any one of Paras. 1-20, wherein the composition further comprises a water miscible boiling point elevator and freezing point depressant comprising glycol, polyglycol, glycerol, propylene glycol, an alkaline earth metal salt, and citric acid, or a salt or a combination thereof.

Para. 26. The composition of any one of Paras. 1-25, wherein the composition is a high temperature fire resistant grease.

Para. 27. The composition of Para. 26, wherein the composition does not catch fire when subjected to direct flame and or sparks.

Para. 28. The composition of Para. 26, wherein the high temperature is a temperature that exceeds the flash point of hydrocarbon mineral oil or hydrocarbon synthetic oils based greases and/or is above 500° F.

Para. 29. The composition of any one of Paras. 1-25, wherein the composition is a lubricant for electric vehicles, whereby electric conductivity is highly desired.

Para. 30. The composition of Para. 29, wherein the composition has a conductivity that prevents the electric discharge currents that occur in hydrocarbon-based greases and can damage the bearings due to sparking.

Para. 31. The composition of any one of Paras. 1-25, wherein the composition is food safe and/or used in food processing machinery.

Para. 32. The composition of Para. 31, wherein the composition complies with NSF H1 regulation for food safe lubricants and NSF Standard 61 for Drinking Water System lubricant.

Para. 33. The composition of any one of Paras. 1-25, wherein the composition is environmentally friendly and biodegradable.

Para. 34. The composition of Para. 33, wherein non-water components in the composition are biodegradable by more than 65% in 28 days according to the OECD 301B biodegradability test method standard.

Para. 35. The composition of Para. 34, wherein the composition is a lubricant for agricultural machinery equipment, forestry equipment, railroad curve and flange side rail, and/or marine applications where aquatic life is in jeopardy when using hydrocarbon-based greases.

Para. 36. A process for preparing the water-based lubricating grease composition of Para. 1, the process comprising:

blending a suitable amount of water with a salt-based thickener to provide a thickened water-based grease, wherein the salt-based thickener is obtained from contacting a base with a fat; and adding a polymer-based thickener to the thickened water-based grease.

Para. 37. The process of Para. 36, wherein the process further comprises adding an inorganic solid-based thickener.

Para. 38. The process of Para. 36 or 37, wherein the process further comprises adding one or more additives.

As used herein, the following definitions of terms shall apply unless otherwise indicated.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

It is contemplated that any of the compositions described herein can possess any combination of the properties described above. It will be apparent to those skilled in the art that various modifications and variations can be made without departing from the scope or spirit of the invention in its broader aspects as defined in the following claims.

What is claimed is:

1. A composition comprising:

at least 55 wt % water;

a salt-based thickener comprising a potassium, sodium, calcium, or magnesium salt of a $C_8$-$C_{32}$ fatty acid, a dicarboxylic acid, or a hydroxy fatty acid;

a polymer-based thickener comprising lignin sulfonate; and an inorganic solid-based thickener comprising talc, fumed silica, and hydrophobized fumed silica;

wherein the fumed silica and hydrophobized fumed silica are present in a weight ratio of 1:1 and the composition is a water-based lubricating grease, and wherein the composition does not comprise an oil.

2. The composition of claim 1, wherein the composition comprises from about 0.1 wt % to about 20 wt % of the inorganic solid-based thickener.

3. The composition of claim 1, wherein the composition comprises at least 60 wt % water.

4. The composition of claim 3, wherein the composition comprises from about 60 wt % to about 90 wt % water.

5. The composition of claim 1, wherein the composition comprises from about 0.1 wt % to about 30 wt % of the salt-based thickener.

6. The composition of claim 1, wherein the composition comprises from about 0.1 wt % to about 15 wt % of the polymer-based thickener.

7. The composition of claim 1, wherein the composition comprises from about 0.5 wt % to about 30 wt % of total thickener(s).

8. The composition of claim 1, wherein the composition further comprises one or more additives selected from the group consisting of water soluble corrosion inhibitors, anti-wear and load carrying capacity enhancing additives, water miscible boiling point elevators, freezing point depressants, and a mixture of any two or more thereof.

9. The composition of claim 1, wherein the composition further comprises a water soluble corrosion inhibitor comprising a metal salt of sulfonic acid, a metal salt of $C_8$-$C_{32}$ fatty acid, a nitrite salt, an alkanol amines, an amine salt, an imidazoline, an acid amide, or a combination thereof.

10. The composition of claim 1, wherein the composition further comprises:

(i) a anti-wear and load carrying capacity enhancing additive comprising molybdenum dithiocarbamate, molybdenum dithiophosphate, molybdenum disulfide, zinc dialkyldithiophosphate, or overbased calcium sulfonate; or (ii) a water miscible boiling point elevator and freezing point depressant comprising glycol, polyglycol, glycerol, propylene glycol, an alkaline earth metal salt, and citric acid, or a salt or a combination thereof.

11. A process for preparing a water-based lubricating grease composition comprising at least 55 wt % water, a salt-based thickener comprising a potassium, sodium, calcium, or magnesium salt of a $C_8$-$C_{32}$ fatty acid, a dicarboxylic acid, or a hydroxy fatty acid, a polymer-based thickener comprising lignin sulfonate, and an inorganic solid-based thickener comprising talc, fumed silica, and hydrophobized fumed silica, the process comprising:

blending a suitable amount of water with the salt-based thickener to provide a thickened water-based grease, wherein the salt-based thickener is obtained from contacting a base with a fat;

adding the polymer-based thickener to the thickened water-based grease; and adding an inorganic solid-based thickener to the thickened water-based grease to provide the water-based lubricating grease composition;

wherein the fumed silica and hydrophobized fumed silica are present in a weight ratio of 1:1, and wherein the composition does not comprise an oil.

12. The process of claim 11, wherein the process further comprises adding one or more additives.

13. The composition of claim 1, wherein the composition comprises:

at least 55 wt % water;

about 0.1 wt % to about 30 wt % of a salt-based thickener comprising a potassium, sodium, calcium, or magnesium salt of a $C_8$-$C_{32}$ fatty acid, a dicarboxylic acid, or a hydroxy fatty acid;

about 0.1 wt % to about 15 wt % of a polymer-based thickener comprising lignin sulfonate; and about 0.1 wt % to about 20 wt % of an inorganic solid-based thickener comprising talc, fumed silica, and hydrophobized fumed silica.

* * * * *